United States Patent [19]

Lincoln

[11] 3,973,604

[45] Aug. 10, 1976

[54] SINGLE CUTTER PENCIL SHARPENER

[75] Inventor: Walter B. Lincoln, Barnegat, N.J.

[73] Assignee: Hunt Manufacturing Co., Philadelphia, Pa.

[22] Filed: July 14, 1975

[21] Appl. No.: 595,887

[52] U.S. Cl. ..... 144/28.8; 144/28.9

[51] Int. Cl.² ..... B43L 23/04

[58] Field of Search ..... 144/28.8, 28.72, 28.6, 144/28.7, 28.9

[56] References Cited

UNITED STATES PATENTS

| | | | |
|---|---|---|---|
| 819,104 | 5/1906 | Webster | 144/28.7 |
| 1,050,770 | 1/1913 | Klaber et al. | 144/28.72 |
| 1,472,557 | 10/1923 | Dandrieux | 144/28.8 |
| 1,793,558 | 2/1931 | Nishimura | 144/28.8 |

*Primary Examiner*—Donald R. Schran

*Attorney, Agent, or Firm*—Smith, Harding, Earley & Follmer

[57] ABSTRACT

A pencil sharpener has a housing, a single cutter mounted for rotation in the housing, and a fixed pencil guide mounted in the housing and having an opening facing the cutter to expose the end of a pencil to the cutter. A rotatably mounted tube coaxial with the pencil guide extends through the housing and has a gear secured to its outer periphery within the housing. Means simultaneously rotate the cutter and gear. A sleeve mounted on the tube exterior of the housing carries a pair of opposed arms pivotally mounted each of which has a finger to engage a pencil, the tube having a slot to accommodate each finger. A spring interposed between the tube and the sleeve urges the sleeve and the arms in a direction to feed the pencil into the fixed pencil guide.

5 Claims, 10 Drawing Figures

SINGLE CUTTER PENCIL SHARPENER

BACKGROUND OF THE INVENTION

The patents found in the applicant's novelty search are found below:

| | | |
|---|---|---|
| F. H. Smith | 805,886 | Nov. 28, 1905 |
| J. A. Webster | 819,104 | May 1, 1906 |
| B. F. Mayo | 847,423 | Mar. 19, 1907 |
| F. B. Canode | 1,008,949 | Nov. 14, 1911 |
| E. H. Klaber & S. Whitehead | 1,050,770 | Jan. 14, 1913 |
| M. Berndt | 1,504,019 | Aug. 5, 1924 |
| C. Holenstein | 1,565,149 | Dec. 8, 1925 |
| G. W. Dahle | 3,750,724 | Aug. 7, 1973 |

Canode U.S. Pat. No. 1,008,949 appears to be the most relevant prior art. Canode teaches the employment of a single cutter and a rotatable chuck device which feeds a pencil to the cutter. Applicant's claimed device is a marked improvement over the prior art in a number of respects. It has a fixed pencil guide which backs up the pencil opposite the area where it is being abraded by the cutter in contrast, for example, to Canode and the other prior art disclosures which, being absent such a fixed guide, either have inadequate backing for a pencil opposite the cutter or must employ an expensive and rugged chucking arrangement. In addition applicant provides a novel chuck-feed arrangement for the pencil which is at once more effective and far simpler in construction than the devices disclosed in the prior art.

BRIEF SUMMARY OF THE INVENTION

A pencil sharpener has a housing, a single cutter mounted for rotation in the housing and a fixed pencil guide mounted in the housing and having an opening facing the cutter to expose the end of a pencil to the cutter. Feed means rotatably mounted on the housing coaxially with the pencil guide urge a pencil into the guide. Means are provided to simultaneously rotate the cutter and the feed means. Advantageously the sharpener feed means has a tube exterior of the housing which carries a spring biased sleeve carrying means to engage a pencil.

DETAILED DESCRIPTION

Figure 7:
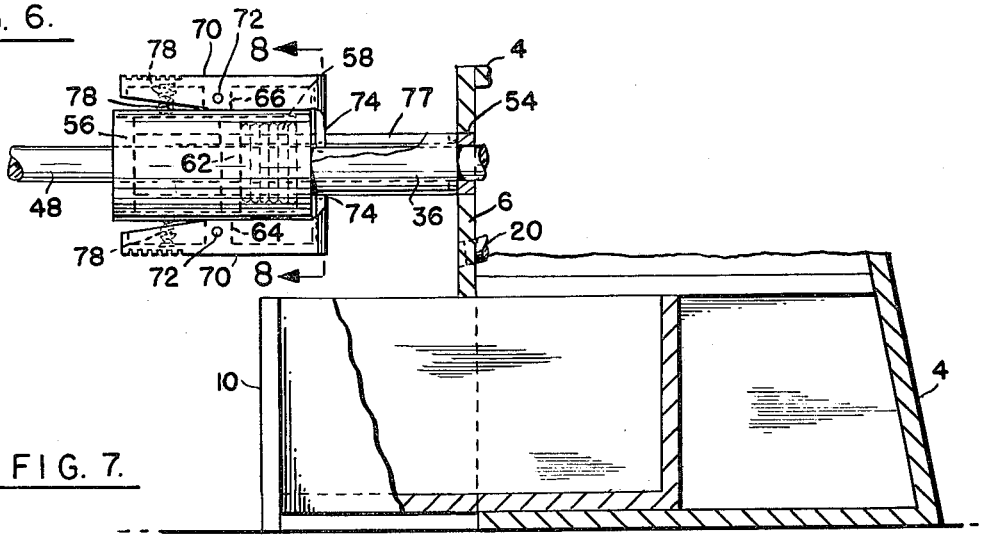
FIG. 7 is a vertical section partially broken away taken on the plane indicated by the line 5—5 in FIG. 1 showing the chuck in its extended position and the waste drawer in a partially open position.

A pencil sharpener 2 has a housing 4 with a removable front panel 6 secured by machine screws 8. Below front panel 6 a waste drawer 10 is slidably mounted inside housing 4 and can be pulled out of the housing as is illustrated in FIG. 7.

Figure 1:
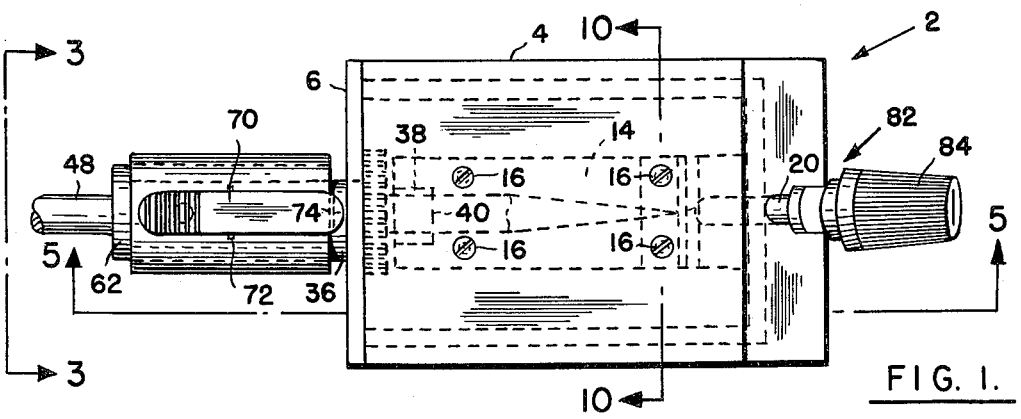
FIG. 1 is a top plan view of a pencil sharpener in accordance with the invention.
Figure 2:
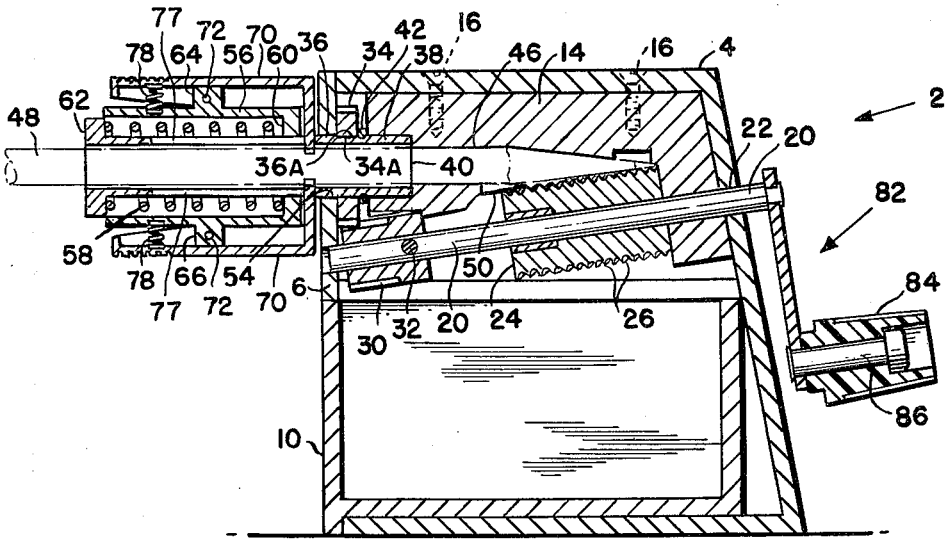
FIG. 2 is a vertical section through the pencil sharpener of FIG. 1.
Figure 3:
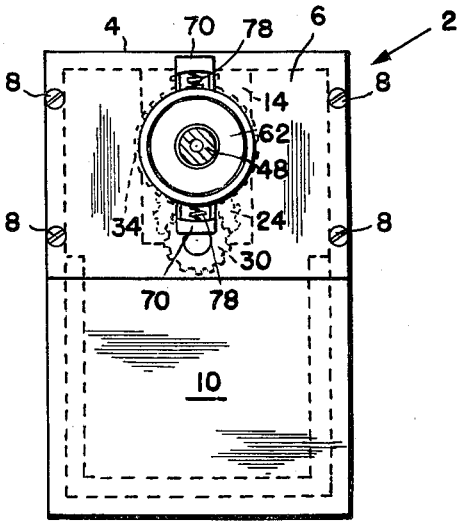
FIG. 3 is a front elevation of the pencil sharpener of FIG. 1.
Figure 4:
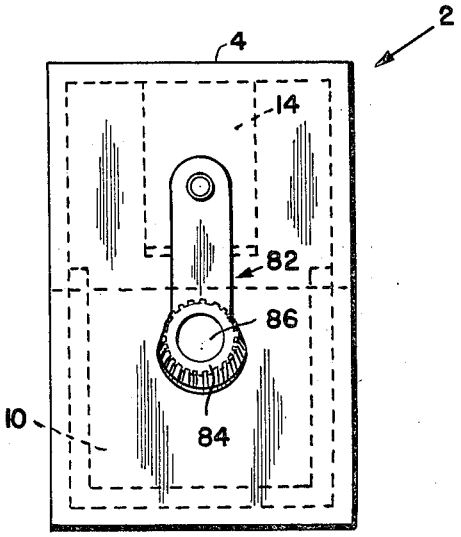
FIG. 4 is a rear elevation of the pencil sharpener of FIG. 1.
Figure 5:
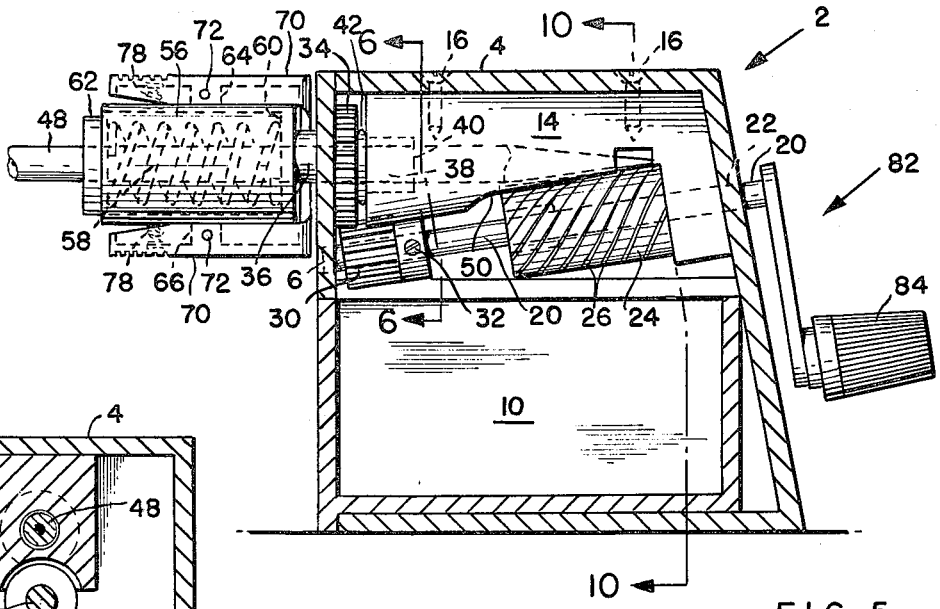
FIG. 5 is a vertical section through the pencil sharpener of FIG. 1 taken on the plane indicated by the line 5—5 in FIG. 1.
Figure 6:
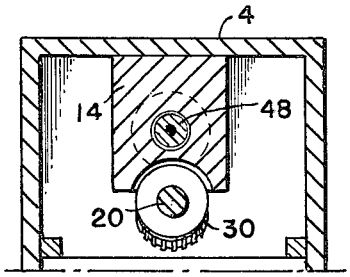
FIG. 6 is a vertical section partially broken away taken on the plane indicated by the line 6—6 in FIG. 5.

A pencil guide block 14 is secured in the upper portion of housing 4 by machine screws 16. A shaft 20 passes through an opening 22 in housing 4 and carries a cutter 24 which is secured thereto by a pressed fit and has teeth 26. Block 14 acts as a thrust bearing where the right-hand end of cutter 24 as viewed in FIG. 2 bears against it.

Shaft 20 also has secured thereto a gear 30 by a screw indicated at 32. Gear 30 meshes with a gear 34 which is secured to the outer periphery of a tube 36. Gear 34 is secured to tube 36 by a pressed fit, the gear having a flat 34A matching flat 36A on tube 36. Tube 36 has an end 38 which is mounted for rotation in opening 40 in block 14 and which is separated from gear 34 by a spring ring 42. Guide block 14 has a pencil guide opening 46 which is coaxial with and communicates with opening 40 and acts to guide a pencil 48 to cutter 24. Block 14 is cut away as indicated at 50 to expose the end of pencil 48 to cutter 24.

Tube 36 passes through an opening 54 in front panel 6 and carries a sleeve 56 which is biased in the direction of cutter 24 by a helical coil spring 58. One end of spring 58 abuts against inwardly extending peripheral flange 60 on sleeve 56 and the other end abuts against outwardly extending peripheral flange 62 on the outer end of tube 36.

Figure 8:
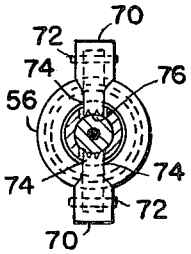
FIG. 8 is a view taken on the plane indicated by the line 8—8 in FIG. 7.
Figure 9:
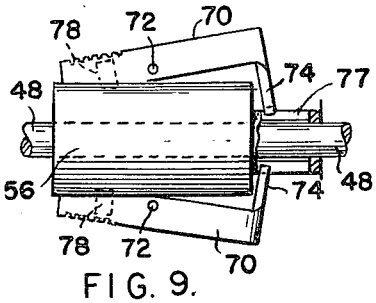
FIG. 9 is a side elevation, partially broken away, showing the chuck device in the open position.
Figure 10:
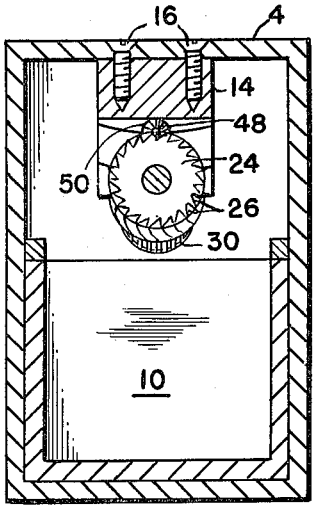
FIG. 10 is a section taken on the plane indicated by the line 10—10 in FIG. 5.

Sleeve 56 has a pair of bosses 64 and 66 each of which carries an arm 70 pivotally secured thereto by a pin 72 passing through the arm and boss. Each arm 70 has a finger 74 with teeth 76 (FIG. 8) adapted to engage and hold pencil 48. Each arm 70 is biased by a compression coil spring 78 between the arm and the sleeve biasing the arm in the direction to cause the finger to engage the pencil. Tube 36 has a slot 77 for each finger 74. Slot 77 is always engaged by its respective finger 74 and permits the finger 74 to move axially with respect to tube 36 and also provides for the rotation of fingers 74, arms 70 and sleeve 56 along with tube 36 when tube 36 is being rotated by a gear 34.

Shaft 20 is provided with a crank 82 having a knurled handle 84 mounted for free rotation on member 86 of crank 82.

OPERATION

In operating the sharpener 2, the arms 70 are grasped and pulled outwardly against the action of coil spring 58 and pinched inwardly against spring 78 to move fingers 74, 74 outwardly. The pencil 48 is then urged through tube 36 until it enters opening 46 and abuts against cutter 24. The pressure on arms 70 is then relaxed sufficiently to permit springs 78 to pivot the arms 70 so that the fingers 74 pivot towards pencil 48 causing teeth 76 to engage and hold the pencil. The arms 70 are then released permitting spring 58 to bias sleeve 56 and arms 70, 70 to the right as viewed in FIG. 2 and hence urge pencil 48 against cutter 24. The sharpener 2 may now be held with one hand while using the other hand to rotate crank 82 so as to cause cutter 24 to be rotated clockwise to abrade the pencil. Simulaneously shaft 20 rotates gear 30 which rotates gear 34 which in turn causes tube 36, sleeve 56, arms 70, 70 and pencil 48 to rotate in the opposite direction from cutter 24. The waste falls into drawer 10. When the pencil has been sharpened, arms 70, 70 are grasped and pivoted to release pencil 48 which may then be withdrawn.

I claim:

1. A pencil sharpener comprising:

a housing, a single cutter mounted for rotation in the housing, a fixed pencil guide mounted in the housing and having an opening facing the cutter to expose the end of a pencil to the cutter, a rotatably mounted tube coaxial with the pencil guide and extending through the housing, a gear concentric with said tube and secured to the outer periphery of the tube within the housing, means connected to the cutter and the gear to rotate the cutter and the gear simultaneously, a sleeve mounted on the tube exterior of the housing for rotation therewith and having means to engage a pencil, and a spring biasing the sleeve towards the housing to advance a pencil in the tube and in the pencil guide.

2. A pencil sharpener in accordance with claim 1 in which the means to engage a pencil is an arm pivotally mounted on the sleeve and having a finger to engage a pencil, the tube having a slot to accommodate the finger.

3. A pencil sharpener in accordance with claim 2 in which the spring is a helical coil spring lying between the tube and the sleeve.

4. A pencil sharpener in accordance with claim 1 in which the means to engage a pencil is a pair of opposed arms pivotally mounted on the sleeve each having a finger to engage a pencil, the tube having a slot to accommodate each finger.

5. A pencil sharpener in accordance with claim 4 in which the spring is a helical coil spring lying between the tube and the sleeve.

* * * * *